US005931137A

United States Patent [19]

McLeod et al.

[11] Patent Number: 5,931,137

[45] Date of Patent: Aug. 3, 1999

[54] DISCHARGE IGNITION APPARATUS FOR INTERNAL COMBUSTION ENGINE HAVING AUTOMATIC SPARK ADVANCE

[75] Inventors: Paul W. McLeod, Warrenville; Charles W. Brinkley, Aiken, both of S.C.

[73] Assignee: R.E. Phelon Co., Inc., Aiken, S.C.

[21] Appl. No.: 08/866,492

[22] Filed: May 30, 1997

[51] Int. Cl.[6] ..... F02P 3/06

[52] U.S. Cl. ..... 123/406.57; 123/601; 310/70 A; 315/218

[58] Field of Search ..... 123/418, 601, 123/602, 149 C, 406.56, 406.57; 310/70 A; 315/218

[56] References Cited

U.S. PATENT DOCUMENTS

| | | | |
|---|---|---|---|
| Re. 27,477 | 9/1972 | Piteo | 123/406.57 |
| Re. 31,837 | 2/1985 | Burson . | |
| 3,515,109 | 6/1970 | Farr . | |
| 3,598,098 | 8/1971 | Sohner et al. | 123/601 |
| 3,599,615 | 8/1971 | Foreman et al. | 123/406.57 |
| 3,646,667 | 3/1972 | Janisch . | |
| 3,651,795 | 3/1972 | Noddin . | |
| 3,661,132 | 5/1972 | Farr . | |
| 3,722,488 | 3/1973 | Swift et al. | 123/602 |
| 3,809,040 | 5/1974 | Burson et al. . | |
| 3,838,671 | 10/1974 | Farr . | |
| 4,079,712 | 3/1978 | Nagasawa | 123/602 |
| 4,538,586 | 9/1985 | Miller . | |
| 5,513,619 | 5/1996 | Chen et al. . | |
| 5,606,958 | 3/1997 | Chrintz-Gath et al. | 123/601 |

OTHER PUBLICATIONS

US application No. 08/787,786, McLeod , filed Jan. 23, 1997.

*Primary Examiner*—Andrew M. Dolinar
*Attorney, Agent, or Firm*—Dority & Manning, P. A.

[57] ABSTRACT

An improved capacitive discharge ignition apparatus provides spark advance with engine speed. The ignition apparatus includes at least one trigger circuit including a trigger coil preferably contained in a common housing with other circuit elements. In this case, an auxiliary coil may be provided to cancel certain pulses in the trigger coil output that could otherwise interfere with desired operation. In some embodiments, a second trigger circuit is provided to derive a triggering signal from the primary coil of the ignition's step-up transformer. A triggering signal of appropriate magnitude received from either trigger circuit will cause discharge of an energy storage element through the primary coil.

36 Claims, 8 Drawing Sheets

DISCHARGE IGNITION APPARATUS FOR INTERNAL COMBUSTION ENGINE HAVING AUTOMATIC SPARK ADVANCE

BACKGROUND OF THE INVENTION

The present invention generally relates to an improved ignition system for use in an internal combustion engine. More particularly, the invention relates to a discharge ignition apparatus that provides automatic spark advance at predetermined operating speeds.

In the case of large displacement engines, ignition circuits of relatively elaborate design have often been provided to advance the ignition spark as engine speed is increased. For example, the spark may be delayed at starting speeds until approximately peak compression of the engine's piston. At higher engine speeds, the spark is preferably advanced to occur before peak compression. In many cases, an advance of twenty (20) mechanical degrees or more would not be uncommon.

The present invention is directed to various novel ignition arrangements providing automatic spark advance that are particularly well-suited for smaller displacement engines.

SUMMARY OF THE INVENTION

In one aspect, the present invention provides an ignition apparatus for use with an internal combustion engine to produce an electrical spark at a spark ignition device. The apparatus comprises a magnet assembly, including a pair of pole faces, operatively revolved along a circular path. A magnetically permeable core having at least two leg portions each including a respective end face is mounted adjacent the circular path. The leg portions are situated such that the pole faces pass proximate to the end faces during revolution of the magnet assembly. As a result, a time-varying magnetic flux is produced in the magnetically permeable core.

The ignition apparatus further includes a transformer having a primary coil and a secondary coil related by a predetermined step-up ratio. The secondary coil is electrically connected during operation to the spark ignition device. A spark generation circuit is operative to apply a primary voltage pulse to the primary coil responsive to a triggering signal of a predetermined polarity. A spark generating pulse is responsively produced in the secondary coil.

In addition, the ignition apparatus includes triggering circuitry having a trigger coil and an auxiliary coil connected in circuit. For example, the auxiliary coil may be connected in series with the trigger coil. The triggering circuitry applies a trigger coil triggering signal of the predetermined polarity to the spark generation circuit to produce a predetermined spark advance at predetermined operating speeds. In some exemplary embodiments, the trigger coil operatively produces first and second excursions of the predetermined polarity with the auxiliary coil substantially cancelling the second excursion from the trigger coil triggering signal.

Often, the spark generation circuit may include a charge coil situated about one of the leg portions of the magnetically permeable core. In such cases, the auxiliary coil is preferably wound coaxial with the charge coil with the trigger coil being spaced apart from the transformer by a predetermined physical angle. For example, the auxiliary coil may comprise a tap from the charge coil at a predetermined number of turns. The trigger coil may be wound about a magnetically permeable pole piece separate from the magnetically permeable core. Preferably, the transformer and the trigger coil are mounted inside of a common housing.

In some exemplary embodiments, the triggering circuitry further comprises a primary coil trigger circuit adapted to apply a primary coil triggering signal to the spark generation circuit. For example, the primary coil trigger circuit may comprise a voltage divider network connected across the primary coil for producing the primary coil triggering signal at a divider node thereof. The spark generation circuitry will often include an electronic switch having a common node to which the trigger coil triggering signal and the primary coil triggering signal are applied.

In other aspects, the present invention provides an ignition apparatus for use with an internal combustion engine to produce an electrical spark at a spark ignition device. The apparatus comprises a magnet assembly, including a pair of pole faces, operatively revolved along a circular path. A magnetically permeable core having at least two leg portions each including a respective end face is mounted adjacent to the circular path. The leg portions are situated such that the pole faces pass proximate to the end faces during revolution of the magnet assembly. As a result, a time-varying magnetic flux is produced in the magnetically permeable core.

The ignition apparatus further includes a transformer having a primary coil and a secondary coil related by a predetermined step-up ratio. The secondary coil is electrically connected during operation to the spark ignition device. A spark generation circuit is operative to apply a primary voltage pulse to the primary coil responsive to a triggering signal of a predetermined polarity. A spark generating pulse is responsively produced in the secondary coil.

In addition, the ignition apparatus includes triggering circuitry having a trigger coil spaced apart from the transformer by a predetermined physical angle. The trigger coil applies a trigger coil triggering signal to the spark generation circuit to produce a predetermined spark advance at predetermined operating speeds. The trigger coil is wound about a magnetically permeable pole piece separate from the magnetically permeable core, but is mounted inside a common housing with the transformer.

In some exemplary embodiments, the triggering circuitry further comprises a primary coil trigger circuit adapted to apply a primary coil triggering signal to the spark generation circuit. For example, a voltage divider network may be connected across the primary coil for producing the primary coil triggering signal at a divider node thereof. The spark generation circuitry will often include an electronic switch having a common node to which the trigger coil triggering signal and the primary coil triggering signal are applied.

The triggering circuitry of the ignition apparatus may further comprise an auxiliary coil electrically connected in series with the trigger coil. The spark generation circuit may include a charge coil situated about a leg portion of the magnetically permeable core, with the auxiliary coil being wound coaxial with the charge coil. For example, the auxiliary coil may comprises a tap from the charge coil at a predetermined number of turns.

Still further aspects of the present invention provide a discharge circuit for use in a discharge ignition system of the type operative to produce an electrical spark at a spark ignition device. The discharge circuit comprises a storage capacitor, a charge coil, and a rectifier electrically connected therebetween. A transformer is also provided, including a primary coil and a secondary coil. The secondary coil is electrically connected during operation to the spark ignition device to produce the electrical spark.

The discharge circuit further includes an electronic switch electrically connected in circuit with the storage capacitor and the primary coil. The electronic switch is rendered conductive by a triggering signal applied to a triggering node thereof. Toward this end, a triggering circuit is electrically connected to the triggering node. The triggering circuitry includes a trigger coil and an auxiliary coil arranged in series to apply a modified trigger coil signal to the triggering node. In some exemplary embodiments, a diode is electrically connected between the trigger coil and the triggering node. Preferably, a resistor is also electrically connected between the trigger coil and the triggering node.

Additional aspects of the present invention are provided by a discharge ignition apparatus for use with an internal combustion engine to produce an electrical spark at a spark ignition device. The apparatus comprises a movable magnet assembly including a pair of pole faces. A magnetically permeable core is provided, having at least two leg portions each including a respective end face. The magnetically permeable core is mounted such that the pole faces pass proximate to the end faces as the magnet assembly is operatively moved in a cyclical manner to produce a time-varying magnetic flux in the magnetically permeable core. A housing is mounted to at least one of the leg portions of the magnetically permeable core. A transformer having a primary coil and a secondary coil is located in the housing and situated about the magnetically permeable core. The secondary coil of the transformer is electrically connected during operation to the spark ignition device.

The discharge ignition apparatus further comprises a discharge circuit located in the housing. The discharge circuit includes a charge coil situated about the magnetically permeable core to have a charging voltage induced thereon by the magnetic flux. As a result, a charging energy is supplied to an energy storage element.

An electronic switch is electrically connected in circuit with the energy storage element and the primary coil. Activation of the electronic switch during operation produces a voltage on the primary coil. Toward this end, triggering circuitry is provided, including a trigger coil spaced apart from the transformer by a predetermined physical angle and having a pole piece separate from the magnetically permeable core. The triggering circuitry operates to apply a triggering signal to the electronic switch yielding a predetermined spark advance at predetermined operating speeds.

In some presently preferred embodiments, the triggering circuitry further comprises a primary coil trigger circuit such as a voltage divider network connected across the primary coil. In many such embodiments, the electronic switch will have a single triggering node.

The triggering circuitry may also comprise an auxiliary coil electrically connected in series with the trigger coil. Preferably, the auxiliary coil may be wound coaxial with the charge coil. For example, the auxiliary coil may comprise a tap from the charge coil at a predetermined number of turns.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
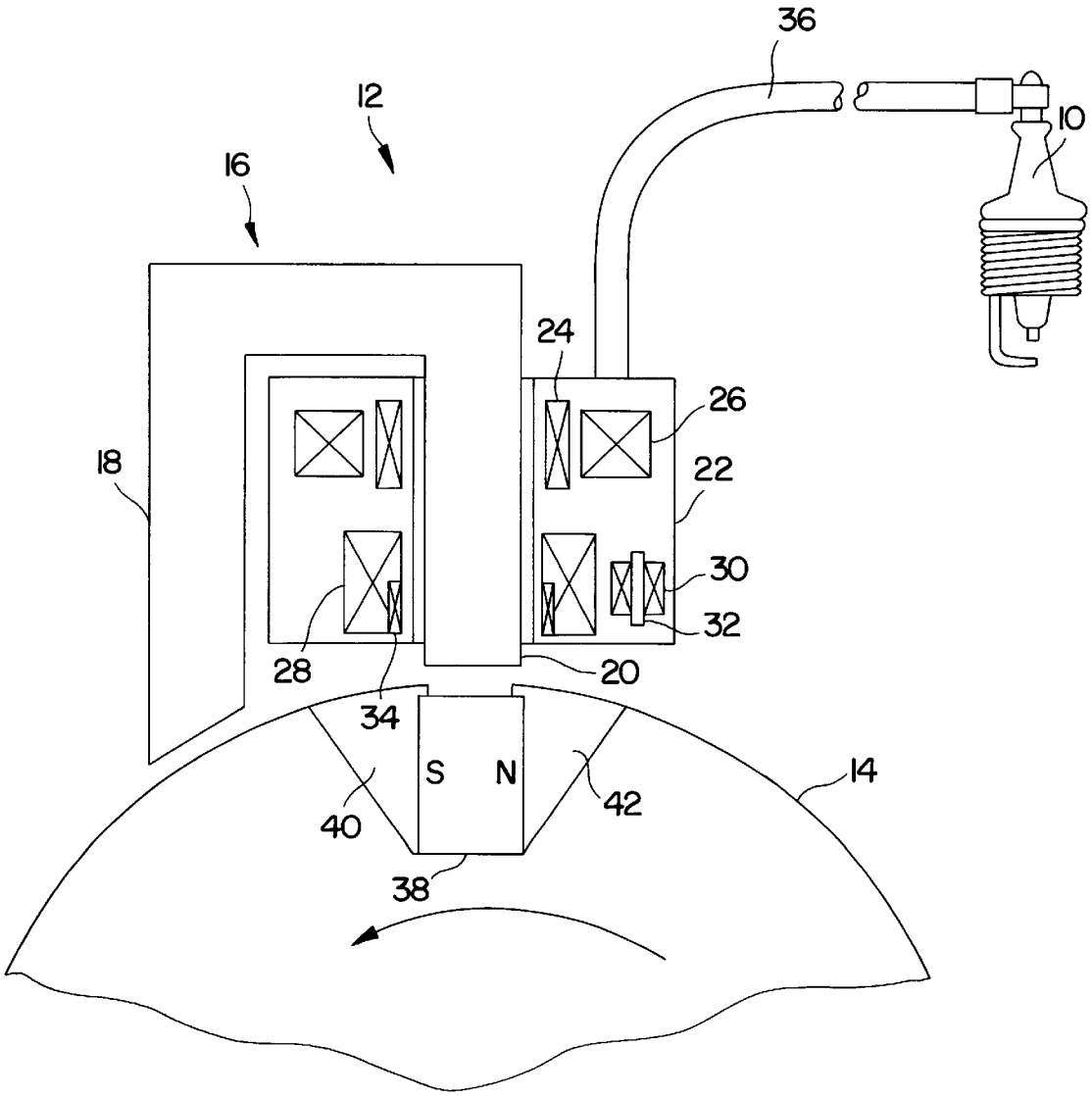
FIG. 1 is an elevational view of various components in a discharge ignition system such as may be constructed according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a discharge ignition apparatus constructed in accordance with the present invention. The apparatus is configured to produce the requisite spark at spark plug 10 to ignite the air-fuel mixture within the piston cylinder of the engine. The apparatus may be used with various devices powered by gasoline engines, particularly hand-held two-cycle and four-cycle gasoline engines.

Generally, the apparatus includes a stator unit 12 and a rotatable flywheel 14. Flywheel 14 typically includes a central bore for mounting to a rotatable spindle mechanically interconnected with the engine's drive shaft. As a result, rotation of the spindle will produce a concomitant rotation of flywheel 14 (such as in the direction indicated by the arrow).

Stator unit 12, which typically remains fixed with respect to the engine during use, includes a magnetically permeable core 16. In this case, core 16 includes two depending leg portions, respectively indicated at 18 and 20. In many embodiments, however, the magnetically permeable core may be constructed having three such leg portions.

A sealed housing 22 maintains the various coils and other components utilized to produce a spark at spark plug 10. In particular, housing 22 includes a transformer having a primary coil 24 and a secondary coil 26. In the illustrated embodiment, coils 24 and 26 may be mounted coaxially about leg portion 20. A charge coil 28, which may also be mounted about leg portion 20, provides a source of energy for the ignition spark as will be explained more fully below.

A trigger coil 30 is also contained within housing 22, wound about a separate, magnetically permeable pole piece 32. An auxiliary coil 34 is wound coaxial with charge coil 28 to provide a "tight" electromagnetic coupling thereto. Preferably, charge coil 28 and auxiliary coil 34 are configured as a single coil from which the ground node is tapped at a predetermined number of turns.

The various components within housing 22 may be protected and maintained securely in position via a suitable potting compound. Electrical connection with spark plug 10 is achieved by a typical interconnecting wire 36.

A magnet assembly is mounted adjacent the periphery of flywheel 14 to revolve about a circular path in synchronism with operation of the engine. The magnet assembly includes a permanent magnet 38 having pole pieces 40 and 42 mounted at respective ends thereof. It will be appreciated that the circumferential faces of pole pieces 40 and 42 will pass proximate to the end faces of leg portions 18 and 20 as flywheel 14 is rotated. Rotation of flywheel 14 thus produces a time-varying magnetic flux within core 16, as desired.

It can be seen that pole piece 32 is separated from leg portion 20 by a predetermined physical angle. The separation between pole piece 32 and leg portion 20 causes a time-varying flux to be induced in pole piece 32 before the flux induced in core 16. This leading flux can be used to provide spark advance in the manner described in more detail below.

Preferably, the air gap between core 16 and pole pieces 40 and 42 will be much smaller than the air gap between pole piece 32 and pole pieces 40 and 42. For example, the air gap with core 16 may fall within a range of 0.010" to 0.015" in some preferred embodiments. In such cases, the air gap with pole piece 32 may be on the order of 0.25". The larger air gap produces a more rounded pulse shape used for spark advance as will be described below.

With smaller engines, the flywheel will often have a radius of between about 1.75" to 2.0". In such cases, the physical separation between leg portion 20 and pole piece 32 will often be about 0.5", or about 14 to 16 mechanical degrees.

Figure 2:
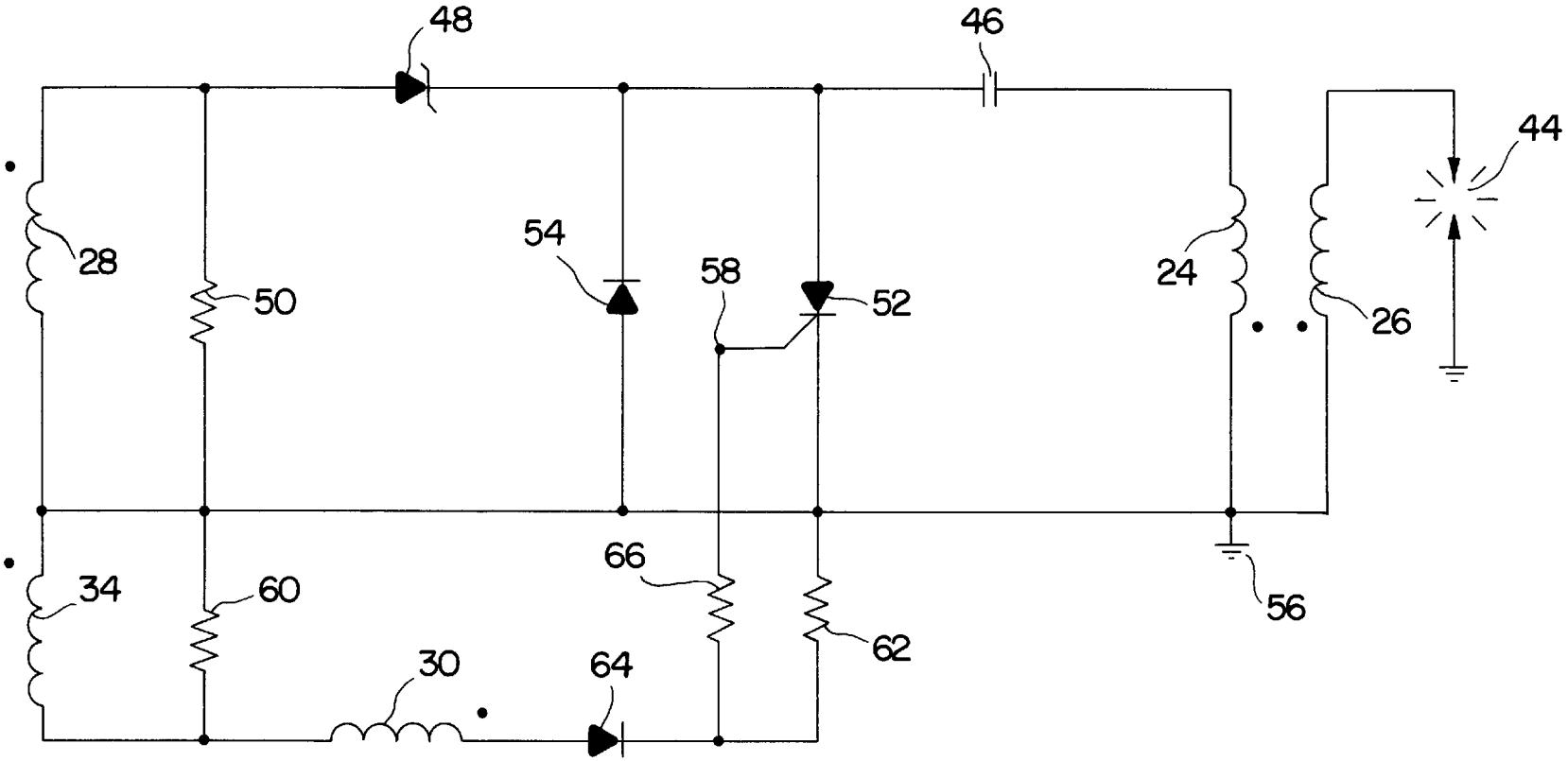
FIG. 2 is a schematic diagram illustrating an exemplary electronic ignition circuit constructed according to the present invention.

FIG. 2 illustrates the various electronic components contained within sealed housing 22 in one preferred embodiment of the present invention. As can be seen, secondary coil 26 is connected across the gap 44 of spark plug 10. Charge coil 28 is electrically connected to a storage capacitor 46 through a rectifier diode 48. A resistor 50 is provided to attenuate transient voltages produced as diode 48 changes from forward conducting to reverse blocking. In addition, diode 48 may be a breakdown diode of predetermined characteristics to prevent overvoltage on charge coil 28 which could occur by transformer action during the main discharge.

Capacitor 46 is, in turn, electrically connected in circuit with primary coil 24 through a silicon-controlled rectifier (SCR) 52. Diode 54 functions as a ringback diode for reversal of the polarity of capacitor 46 during discharge. A relative ground, as indicated at 56, typically provides electrical communication with the engine block. Although not shown, a stop switch may be provided to selectively ground charge coil 28 and thereby disable operation of the ignition system.

SCR 52 is rendered conductive by application of a triggering signal to triggering node 58, which is the SCR gate. In this case, the triggering signal is produced by a triggering circuit including trigger coil 30 and auxiliary coil 34 connected in series as shown. It can thus be seen that the triggering signal is the output of trigger coil 30, as modified by the various elements of the trigger circuit.

In the illustrated embodiment, the trigger circuit includes a loading resistor 60 provided across auxiliary coil 34. A further loading resistor 62 is provided between ground and the output of trigger coil 30. As one skilled in the art will recognize, resistors 60 and 62 appropriately scale the induced voltage on their respective coil. Diode 64 and resistor 66 act together to protect SCR 52 from harmful voltages and suppress any unwanted leakage pulses.

The operation of the circuit shown in FIG. 2 will now be explained with reference to the waveforms illustrated in FIGS. 3A through 3D. The illustrated waveforms are merely diagrammatic in nature for which scale is not implied. In addition, one skilled in the art will recognize that references to "positive" or "negative" are merely a matter of convention. It will also be appreciated that the illustrated sequence is repeated for every revolution of the magnet assembly.

Figure 3A:
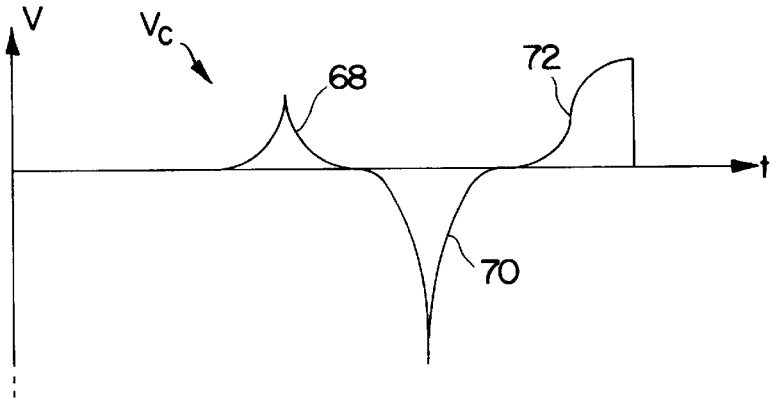
FIGS. 3A through 3D diagrammatically illustrate various voltage plots taken at respective locations in the circuit of FIG. 2.

FIG. 3A illustrates a waveform $V_c$ of the voltage produced across charge coil 28 during one passage of the magnet assembly carried by flywheel 14. As can be seen, waveform $V_c$ includes a first positive excursion 68 followed by a relatively large negative excursion 70. A further positive excursion 72 follows negative excursion 70. One skilled in the art will recognize excursion 72 as a typical series RCL response to the exponential voltage generated by the charge coil. Capacitor 46 is charged to its peak value at this time.

Figure 3B:
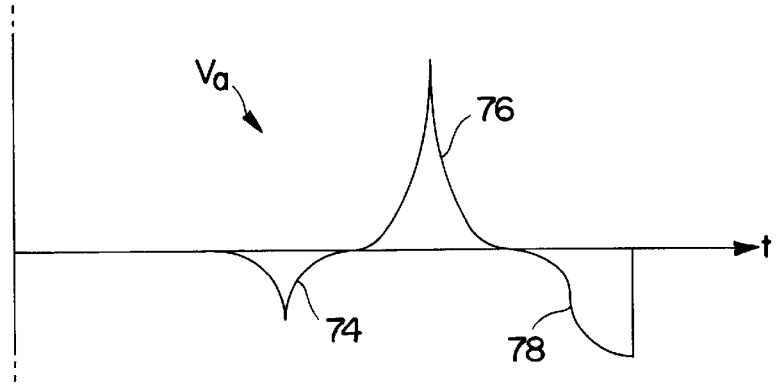

FIG. 3B illustrates a waveform $V_a$ such as may be induced across auxiliary coil 34 at corresponding points in time. Because auxiliary coil 34 is tightly coupled to charge coil 28 as explained above, waveform $V_a$ will have a shape similar to $V_c$, but opposite polarity and different magnitude. Thus, waveform $V_a$ exhibits a negative excursion 74 followed by a positive excursion 76. Positive excursion 76 is then followed by a negative excursion 78.

Figure 3C:
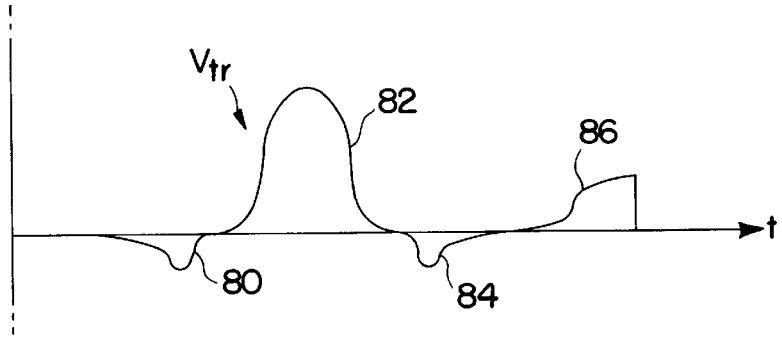

FIG. 3C illustrates waveform $V_{tr}$ produced across trigger coil 30, which has four excursions 80, 82, 84 and 86. It can be seen that excursions 80 and 84 are negative, with excursions 82 and 86 being positive. Excursions 80, 82 and 84 are produced by generator action as the magnet assembly carried by flywheel 14 passes pole piece 32. This part of waveform $V_{tr}$ is time shifted forward with respect to waveform $V_c$. As noted above, the relatively "loose" coupling between pole piece 32 and magnet 38 provides a more rounded waveform shape, which allows the time-shifted signal to provide a relatively large spark advance.

Excursion 86 of waveform $V_{tr}$ is produced by transformer interaction between charge coil 28 and trigger coil 30 during the capacitor charging cycle. This results from the close proximity of these two coils in compact module packages such as that shown in the illustrated embodiment. It will be appreciated that excursion 86 should not reach node 58, or capacitor 46 will be shorted at the onset of when it would otherwise be charged.

While a number of electronic techniques may suitably suppress excursion 86, the illustrated embodiment utilizes coils to provide an equal and opposite pulse. In particular, auxiliary coil 34, strongly coupled to the source of unwanted pulse, produces excursion 78 in opposition to excursion 86. Resistor 60 loads excursion 78 to the appropriate level for addition to the output of trigger coil 30.

Figure 3D:
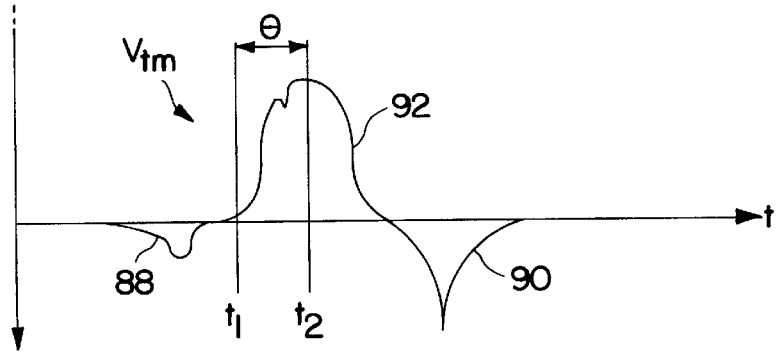

FIG. 3D shows the resultant waveform $V_{tm}$, which may be applied to triggering node 58 through diode 64. As can be seen, the trigger coil output has been modified to eliminate the undesired positive excursion during charging of capacitor 46. The resulting negative excursions 88 and 90 are blocked by diode 64. The relatively large positive excursion 92 passes through diode 64 and gates SCR 52. As a result, energy stored in capacitor 46 during the previous charging cycle is released to primary coil 24.

It will be appreciated that excursion 92 will not gate SCR 52 until a certain gating threshold is reached. At low engine speed, the gating threshold will not be reached until a time $t_2$ near the peak of excursion 92. As speed is increased, the point on the waveform where gating occurs will move down the rounded curve (or back in time), yielding spark advance with speed. The maximum spark advance occurs at time $t_1$. In many embodiments, the advance angle e represented by the region between times $t_1$ and $t_2$ may be at least fifteen mechanical degrees.

Figure 4:
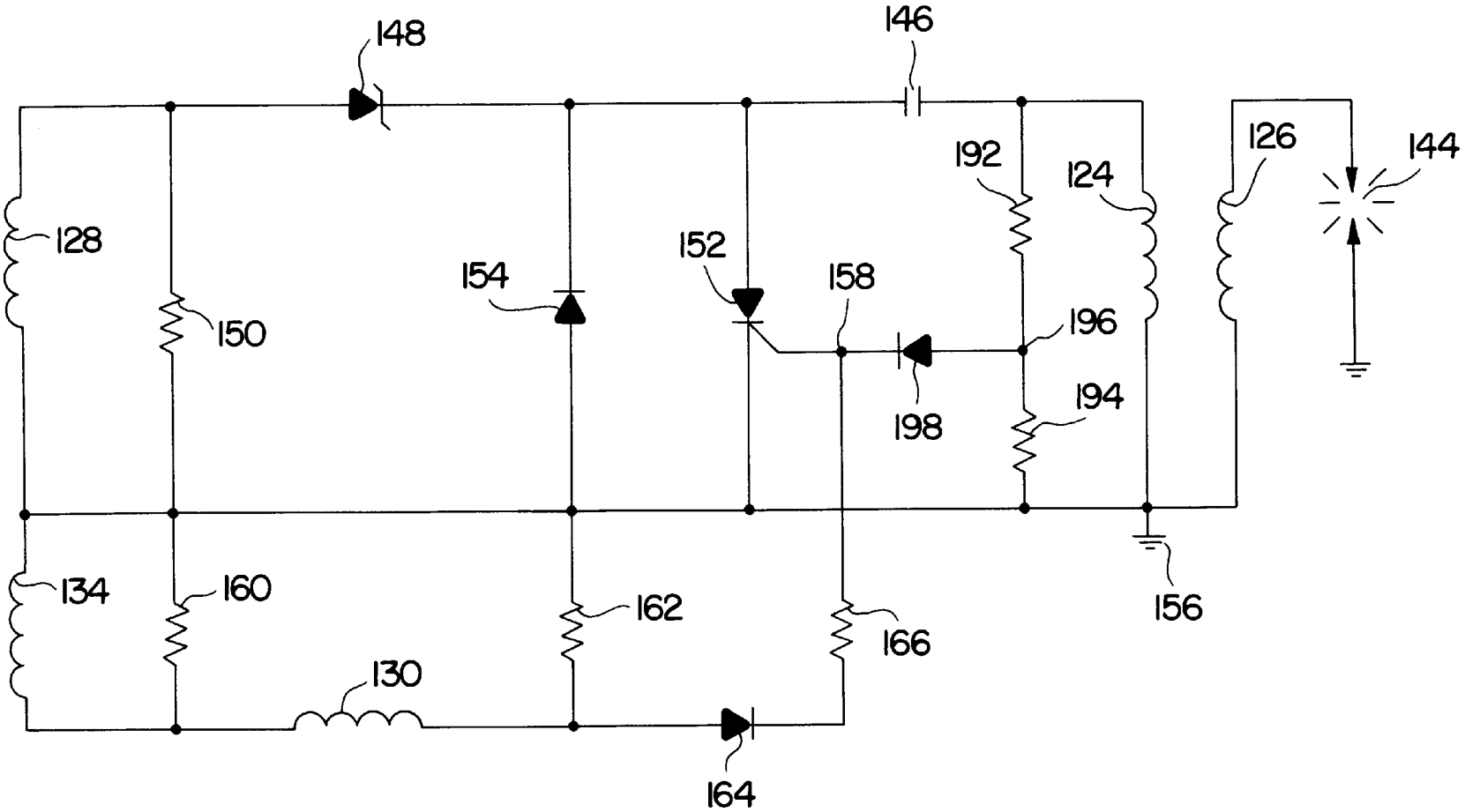
FIG. 4 is a schematic diagram illustrating an alternative electronic ignition circuit constructed according to the present invention.

FIG. 4 illustrates an alternative circuit arrangement that may achieve an even greater degree of spark advance. Many aspects of this circuit are similar to the circuit of FIG. 2 and, for the sake of brevity, will not be discussed in detail. Common or analogous elements have been given a reference number augmented by one-hundred in relation to their counterparts in the previous embodiment.

In this case, it can be seen that a voltage divider network has been provided across primary coil 124. This voltage divider network includes a pair of serially connected resistors 192 and 194 defining a divider node 196 therebetween. Divider node 196 is, in turn, connected to triggering node 158 through diode 198.

FIGS. 5A through 5E illustrate various waveforms produced in the circuit of FIG. 4. The first four waveforms, i.e., FIGS. 5A through 5D, are similar to waveforms produced at corresponding locations in the circuit of FIG. 2. For purposes of simplicity, FIG. 5B also indicates the primary coil waveform $V_p'$, since this waveform will have a polarity and shape similar to the auxiliary coil waveform $V_a'$.

Figure 5A:
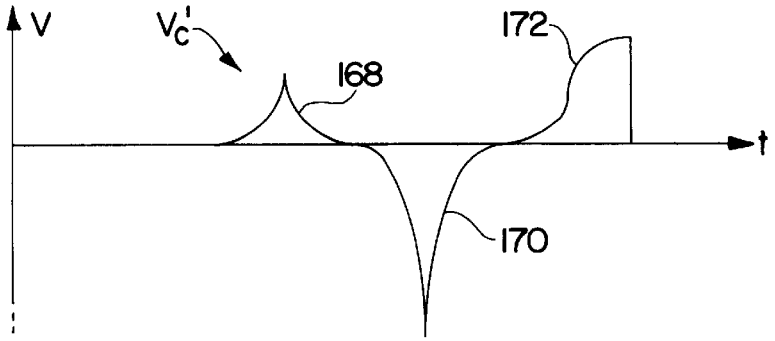
FIGS. 5A through 5E diagrammatically illustrate various voltage plots taken at respective locations in the circuit of FIG. 4.
Figure 5B:
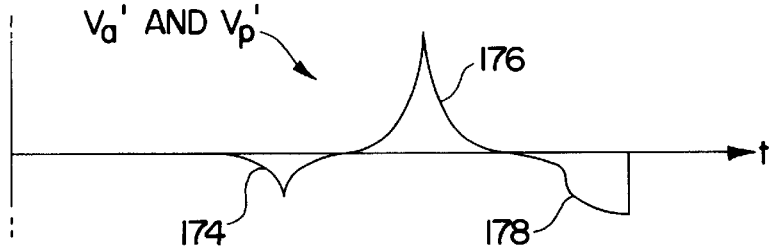
Figure 5C:
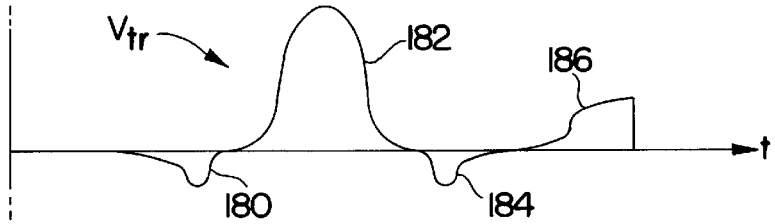
Figure 5D:
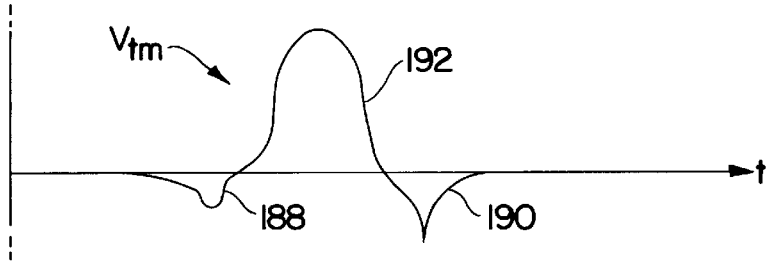
Figure 5E:
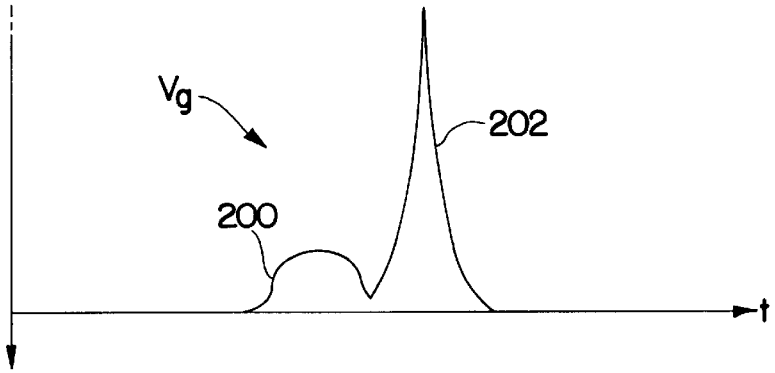

The primary coil waveform $V_p'$ is scaled by the voltage divider network and applied to node 158 through diode 198. This is in addition to the waveform $V_{tm}'$ which is also applied to node 158 through diode 164. The cumulative waveform $V_g$ applied to node 158 through the combined action of these two triggering circuits is shown in FIG. 5E. As can be seen, waveform $V_g$ has a first positive excursion 200 contributed by the waveform $V_{tm}$, followed by a second positive excursion 202 of greater amplitude contributed by waveform $V_p'$.

Figure 6A:
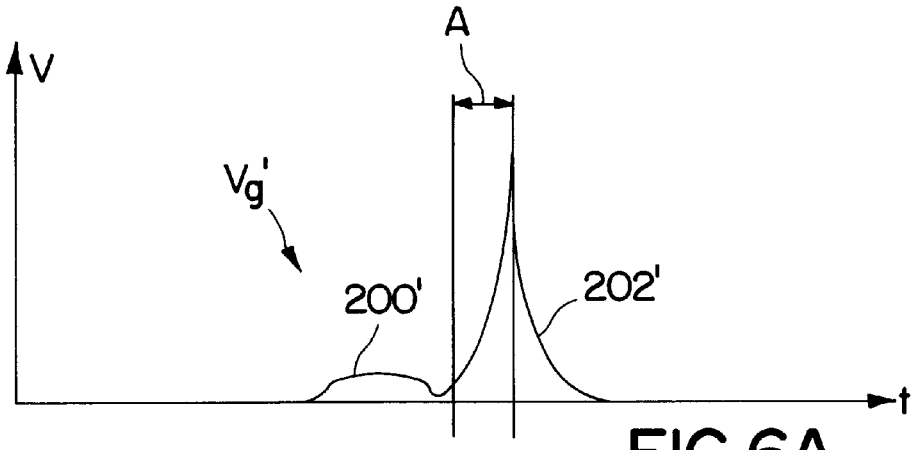
FIGS. 6A and 6B are enlarged plots of the gating signal produced in the circuit of FIG. 4 at low speed and high speed, respectively.
Figure 6B:
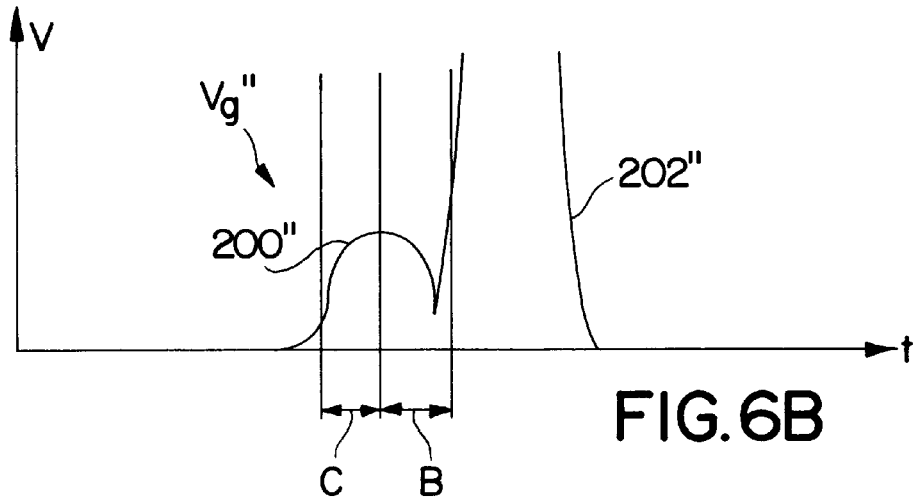

The manner in which the cumulative gating waveform produced in the circuit of FIG. 4 provides the desired spark advance can be most easily understood with reference to FIGS. 6A and 6B. Specifically, FIG. 6A shows a gating waveform $V_g'$ such as may be produced at relatively low engine speeds. In this case, excursion 200' remains below the gating threshold and will thus pass without causing SCR 152 to gate. At the lowest speeds, SCR 152 is gated near the peak of excursion 202'. As shown in the region A, gating will occur earlier along the leading edge of excursion 202' as engine speed is increased.

As shown in FIG. 6B, further increases in engine speed will cause excursion 200" to eventually reach the gating threshold. As this point, indicated by the region B, the gating point will advance in a stepwise manner to the peak of excursion 200". As speed further increases, the gating point will advance down the leading edge of excursion 200", as shown in region C.

Figure 7:
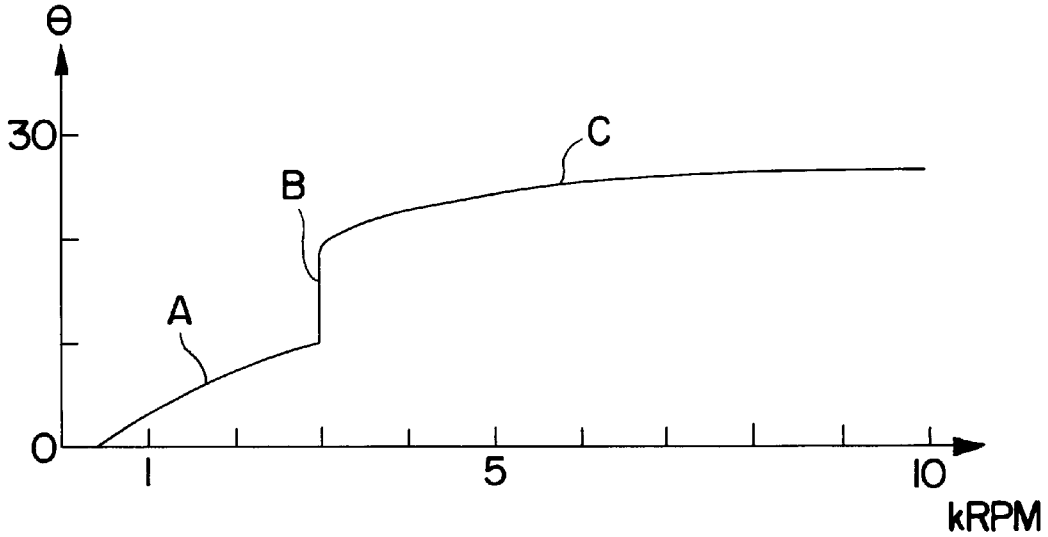
FIG. 7 is a representative plot of advance angle versus speed such as may be exhibited during operation of the circuit of FIG. 4.

FIG. 7 illustrates a typical timing curve that may be produced in the circuit of FIG. 4. As described, the spark will advance gradually in region A before making a significant step advance when region B is reached. After region B, the spark again advances gradually in region C until the maximum advance has been achieved. In many embodiments, a spark advance of at least twenty-five mechanical degrees can be achieved in this manner.

Figure 8A:
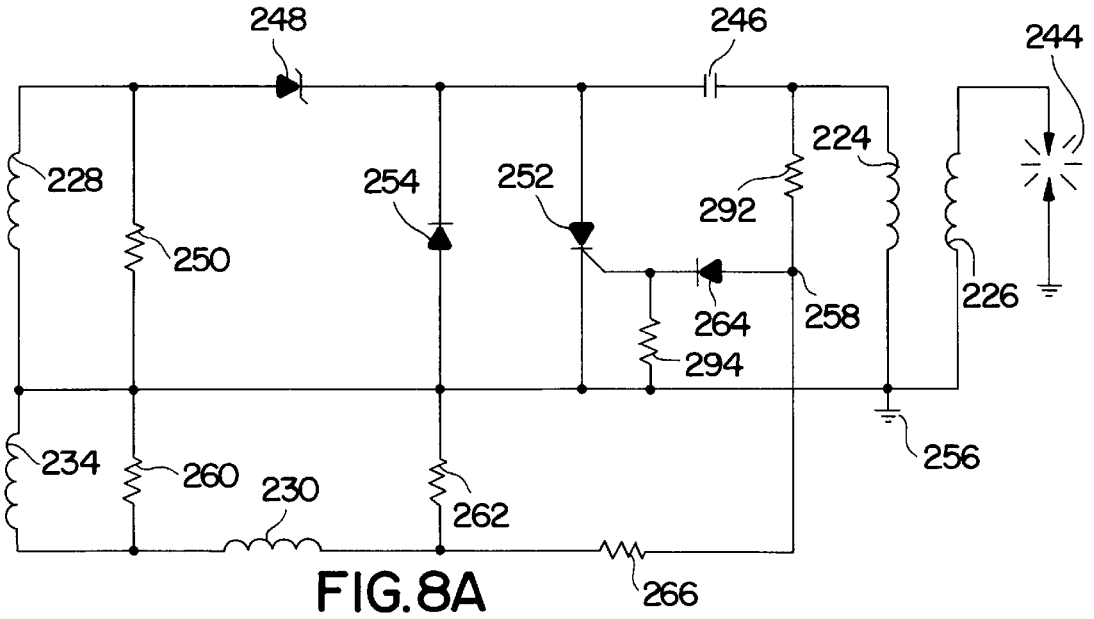
FIGS. 8A through 8C are schematic diagrams of respective further alternative electronic ignition circuits constructed according to the present invention.
Figure 8B:
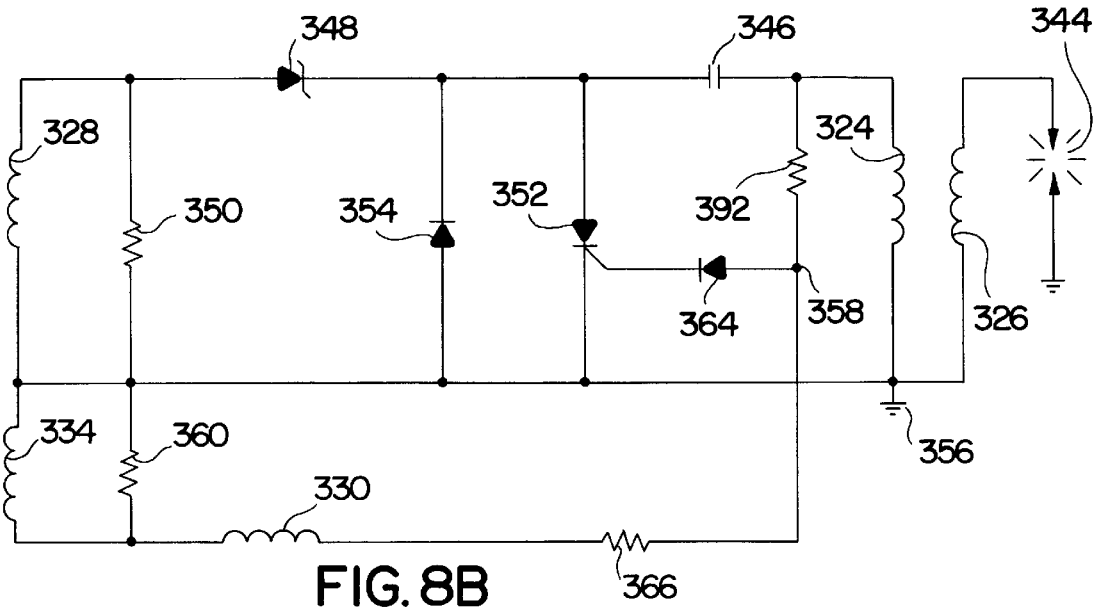
Figure 8C:
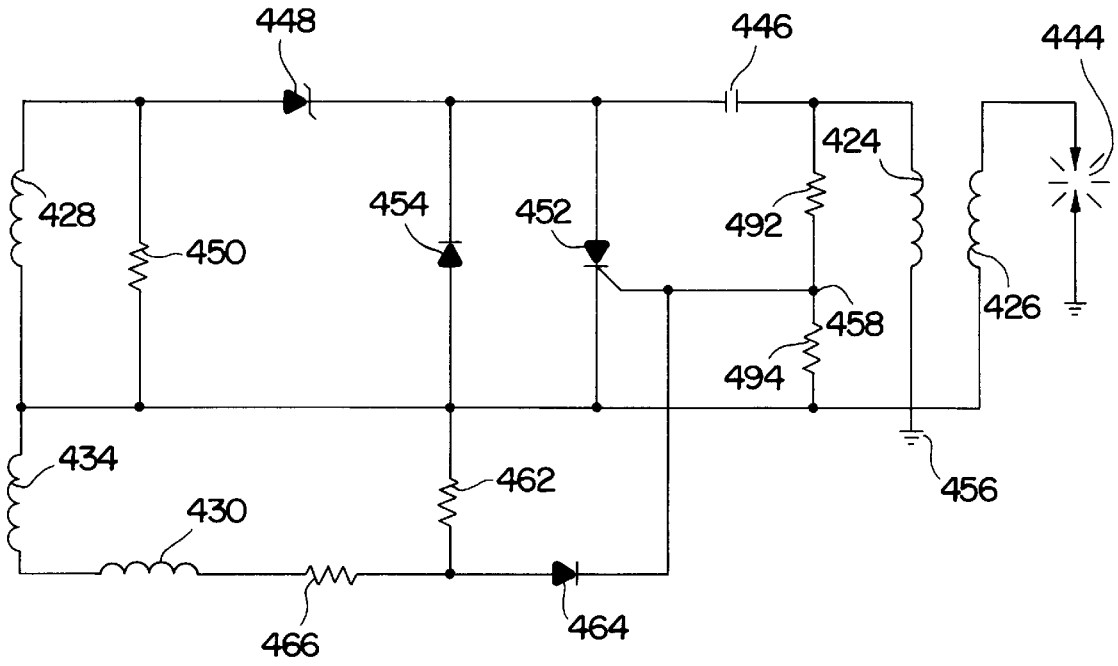

It will be appreciated that various circuit arrangements can be utilized to achieve functional results as described herein. Thus, FIGS. 8A through 8C illustrate further exemplary embodiments of an ignition discharge circuit constructed in accordance with the present invention. Elements common or analogous to previous embodiments are indicated by references numbers augmented by one-hundred in each case. One skilled in the art will understand operation of these circuits without a detailed explanation.

While preferred embodiments of the invention have been shown and described, modifications and variations be made thereto by those of ordinary skill in the art without departing from the spirit and scope of the present invention. For example, it may be desirable in some circuit arrangements to substitute an inductor or other circuit component as the energy storage element. In addition, it should be understood that aspects of various embodiments of the invention may be interchanged both in whole or in part. Furthermore, those of ordinary skill in the art will appreciate that the foregoing description is by way of example only, and is not intended to be limitative of the invention so further described in the appended claims.

What is claimed is:

1. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal of a predetermined polarity, said primary voltage pulse producing a spark generating pulse in said secondary coil; and triggering circuitry including a trigger coil and an auxiliary coil connected in circuit to apply a trigger coil triggering signal of said predetermined polarity to said spark generation circuit to produce a predetermined spark advance at predetermined operating speeds, wherein said trigger coil is wound about a magnetically permeable pole piece separate from said magnetically permeable core and said auxiliary coil is wound about one of said leg portions of said magnetically permeable core, said trigger coil being angularly spaced apart from said transformer by a predetermined physical angle measured about said circular path.

2. An ignition apparatus as set forth in claim 1, wherein said transformer and said trigger coil are mounted inside of a common housing.

3. An ignition apparatus as set forth in claim 1, wherein said spark generation circuit comprises:

(a) an energy storage element;

(b) a charge coil having a voltage induced thereon by said magnetic flux to supply charging energy to said energy storage element during each revolution of said magnet assembly; and (c) an electronic switch electrically connected in circuit with said energy storage element and said primary coil, said electronic switch being rendered conductive by application of said triggering signal thereto.

4. An ignition apparatus as set forth in claim 3, wherein said magnet assembly is carried by a rotatable engine flywheel.

5. An ignition apparatus as set forth in claim 1, wherein a first radial gap between said pole faces of said magnet assembly and said magnetically permeable pole piece is greater than a second radial gap between said pole faces of said magnet assembly and said end faces of said magnetically permeable core.

6. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal of a predetermined polarity, said primary voltage pulse producing a spark generating pulse in said secondary coil; and triggering circuitry including a trigger coil and an auxiliary coil connected in circuit to apply a trigger coil triggering signal of said predetermined polarity to said spark generation circuit to produce a predetermined spark advance at predetermined operating speeds, wherein said trigger coil operatively produces first and second excursions of said predetermined polarity and said auxiliary coil substantially cancels said second excursion from said trigger coil triggering signal.

7. An ignition apparatus as set forth in claim 6, wherein said auxiliary coil is electrically connected in series with said trigger coil.

8. An ignition apparatus as set forth in claim 6, wherein said spark generation circuit includes a charge coil situated about one of said leg portions of said magnetically permeable core, said auxiliary coil being wound coaxial with said charge coil.

9. An ignition apparatus as set forth in claim 8, wherein said trigger coil is spaced apart from said transformer by a predetermined physical angle measured about said circular path.

10. An ignition apparatus as set forth in claim 8, wherein said auxiliary coil and said charge coil are wound as single coil having a tap therefrom at a predetermined number of turns.

11. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal of a predetermined polarity, said primary voltage pulse producing a spark generating pulse in said secondary coil; and triggering circuitry including a trigger coil and an auxiliary coil connected in circuit to apply a trigger coil triggering signal of said predetermined polarity to said spark generation circuit to produce a predetermined spark advance at predetermined operating speeds, wherein said triggering circuitry further comprises a primary coil trigger circuit adapted to apply a primary coil triggering signal to said spark generation circuit.

12. An ignition apparatus as set forth in claim 11, wherein said primary coil trigger circuit comprises a voltage divider network connected across said primary coil for producing said primary coil triggering signal at a divider node thereof.

13. An ignition apparatus as set forth in claim 11, wherein said spark generation circuitry includes an electronic switch having a common node to which said trigger coil triggering signal and said primary coil triggering signal are applied.

14. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal of a predetermined polarity, said primary voltage pulse producing a spark generating pulse in said secondary coil; and triggering circuitry including a trigger coil angularly spaced apart from said transformer to apply a trigger coil triggering signal to said spark generation circuit to produce a predetermined spark advance at predetermined operating speeds, said trigger coil being wound about a magnetically permeable pole piece separate from said magnetically permeable core and mounted inside a common housing with said transformer, said triggering circuitry operative to modify said trigger coil triggering signal such that errant triggering due to electromagnetic coil interaction is alleviated.

15. An ignition apparatus as set forth in claim 14, wherein said triggering circuitry further comprises a primary coil trigger circuit adapted to apply a primary coil triggering signal to said spark generation circuit.

16. An ignition apparatus as set forth in claim 15, wherein said primary coil trigger circuit comprises a voltage divider network connected across said primary coil for producing said primary coil triggering signal at a divider node thereof.

17. An ignition apparatus as set forth in claim 15, wherein said spark generation circuitry includes an electronic switch having a common node to which said trigger coil triggering signal and said primary coil triggering signal are applied.

18. An ignition apparatus as set forth in claim 14, wherein a first radial gap between said pole faces of said magnet assembly and said magnetically permeable pole piece is greater than a second radial gap between said pole faces of said magnet assembly and said end faces of said magnetically permeable core.

19. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal of a predetermined polarity, said primary voltage pulse producing a spark generating pulse in said secondary coil; and triggering circuitry including a trigger coil angularly spaced apart from said transformer to apply a trigger coil triggering signal to said spark generation circuit to produce a predetermined spark advance at predetermined operating speeds, said trigger coil being wound about a magnetically permeable pole piece separate from said magnetically permeable core and mounted inside a common housing with said transformer, said triggering circuitry further comprising a primary coil trigger circuit adapted to apply a primary coil triggering signal to said spark generation circuit, wherein said triggering circuitry further comprises an auxiliary coil electrically connected in series with said trigger coil.

20. An ignition apparatus as set forth in claim 19, wherein said spark generation circuit includes a charge coil situated about one of said leg portions of said magnetically permeable core, said auxiliary coil being wound coaxial with said charge coil.

21. An ignition apparatus as set forth in claim 20, wherein said auxiliary coil and said charge coil are wound as a single coil having a tap therefrom at a predetermined number of turns.

22. A discharge circuit for use in a discharge ignition system of the type operative to produce an electrical spark at a spark ignition device, said discharge circuit comprising:

(a) a storage capacitor;

(b) a charge coil;

(c) a rectifier electrically connected between said charge coil and said storage capacitor;

(d) a transformer including a primary coil and a secondary coil, said secondary coil electrically connected during operation to the spark ignition device to produce the electrical spark;

(e) an electronic switch electrically connected in circuit with said storage capacitor and said primary coil, said electronic switch being rendered conductive by a triggering signal applied to a triggering node thereof; and (f) triggering circuitry electrically connected to said triggering node, said triggering circuitry including a trigger coil and an auxiliary coil arranged in series to apply a modified trigger coil signal to said triggering node, said auxiliary coil being wound coaxial with said charge coil.

23. A discharge circuit as set forth in claim 22, further comprising a diode electrically connected between said trigger coil and said triggering node.

24. A discharge circuit as set forth in claim 23, further comprising a resistor electrically connected between said trigger coil and said triggering node.

25. A discharge circuit as set forth in claim 22, wherein said auxiliary coil and said charge coil are wound as a single coil having a tap therefrom at a predetermined number of turns.

26. A discharge circuit as set forth in claim 22, further including a common housing into which all components of said discharge circuit are mounted.

27. A discharge circuit for use in a discharge ignition system of the type operative to produce an electrical spark at a spark ignition device, said discharge circuit comprising:

(a) a storage capacitor;

(b) a charge coil;

(c) a rectifier electrically connected between said charge coil and said storage capacitor;

(d) a transformer including a primary coil and a secondary coil, said secondary coil electrically connected during operation to the spark ignition device to produce the electrical spark;

(e) an electronic switch electrically connected in circuit with said storage capacitor and said primary coil, said electronic switch being rendered conductive by a triggering signal applied to a triggering node thereof; and (f) triggering circuitry electrically connected to said triggering node, said triggering circuitry including a trigger coil and an auxiliary coil arranged in series to apply a modified trigger coil signal to said triggering node, wherein said triggering circuitry further comprises a primary coil trigger circuit adapted to apply a primary coil triggering signal to said triggering node.

28. A discharge circuit as set forth in claim 27, wherein said primary coil trigger circuit comprises a voltage divider network connected across said primary coil for producing said primary coil triggering signal at a divider node thereof.

29. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved in a cyclical manner to produce a time-varying magnetic flux in said magnetically permeable core;

a housing mounted to at least one of said leg portions of said magnetically permeable core;

a transformer having a primary coil and a secondary coil located in said housing and situated about said magnetically permeable core, said secondary coil electrically connected during operation to the spark ignition device; and a discharge circuit located in said housing, said discharge circuit including:

(a) a n energy storage element;

(b) a charge coil situated about said magnetically permeable core and having a charging voltage induced thereon by said magnetic flux to supply charging energy to said energy storage element;

(c) an electronic switch electrically connected in circuit with said energy storage element and said primary coil, activation of said electronic switch during operation producing a voltage on said primary coil; and (d) triggering circuitry including a trigger coil angularly spaced apart from said transformer and having a pole piece separate from said magnetically permeable core, said triggering circuitry operative to apply a triggering signal to said electronic switch yielding a predetermined spark advance at predetermined operating speeds, said triggering circuitry operative to modify an output signal of said trigger coil such that errant triggering due to electromagnetic coil interaction is alleviated.

30. A discharge ignition apparatus as set forth in claim 29, wherein said triggering circuitry further comprises a primary coil trigger circuit.

31. A discharge ignition apparatus as set forth in claim 30, wherein said primary coil trigger circuit comprises a voltage divider network connected across said primary coil.

32. A discharge ignition apparatus as set forth in claim 31, wherein said electronic switch has a single triggering node.

33. A discharge ignition apparatus as set forth in claim 29, wherein a first radial gap between said pole faces of said magnet assembly and said magnetically permeable pole piece is greater than a second radial gap between said pole faces of said magnet assembly and said end faces of said magnetically permeable core.

34. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved in a cyclical manner to produce a time-varying magnetic flux in said magnetically permeable core;

a housing mounted to at least one of said leg portions of said magnetically permeable core;

a transformer having a primary coil and a secondary coil located in said housing and situated about said magnetically permeable core, said secondary coil electrically connected during operation to the spark ignition device; and a discharge circuit located in said housing, said discharge circuit including:

(a) an energy storage element;

(b) a charge coil situated about said magnetically permeable core and having a charging voltage induced thereon by said magnetic flux to supply charging energy to said energy storage element;

(c) an electronic switch electrically connected in circuit with said energy storage element and said primary coil, activation of said electronic switch during operation producing a voltage on said primary coil; and (d) triggering circuitry including a trigger coil angularly spaced apart from said transformer and having a pole piece separate from said magnetically permeable core, said triggering circuitry operative to apply a triggering signal to said electronic switch yielding a predetermined spark advance at predetermined operating speeds, wherein said triggering circuitry further comprises an auxiliary coil electrically connected in series with said trigger coil.

35. A discharge ignition apparatus as set forth in claim 34, wherein said auxiliary coil is wound coaxial with said charge coil.

36. A discharge ignition apparatus as set forth in claim 35, wherein said auxiliary coil and said charge coil are wound as a single coil having a tap therefrom at a predetermined number of turns.

* * * * *